United States Patent [19]

Giebeler

[11] 4,262,693

[45] Apr. 21, 1981

[54] KELLY VALVE

[75] Inventor: Bernhardt F. Giebeler, San Bernardino, Calif.

[73] Assignee: Bernhardt & Frederick Co., Inc., San Bernardino, Calif.

[21] Appl. No.: 53,854

[22] Filed: Jul. 2, 1979

[51] Int. Cl.[3] ..... E21B 43/12

[52] U.S. Cl. ..... 137/494; 166/321; 175/242; 251/56; 251/58; 251/229

[58] Field of Search ..... 166/321, 323, 324, 329, 166/330, 332; 175/218, 241, 242; 137/494; 251/56, 58, 229, 248

[56] References Cited

U.S. PATENT DOCUMENTS

| | | | |
|---|---|---|---|
| 2,322,064 | 6/1943 | Seweli | 175/242 X |
| 3,035,808 | 5/1962 | Knox | 251/58 |
| 3,583,442 | 6/1971 | Dollison | 166/324 X |
| 3,915,228 | 10/1975 | Giebeler | 166/321 |
| 3,993,136 | 11/1976 | Mott | 166/324 X |
| 4,050,512 | 9/1977 | Giebeler | 166/128 |

*Primary Examiner*—Robert G. Nilson
*Attorney, Agent, or Firm*—Lyon & Lyon

[57] ABSTRACT

A valve adapted for installation at the lower end of a drilling kelly for closing the bore of the kelly when adding a section of drill pipe so that the mud content of the kelly is not discharged onto the derrick floor; the valve also being adapted with minimum change in parts, to be inverted and installed at the upper end of the kelly to serve as a safety valve, providing blow out protection.

12 Claims, 13 Drawing Figures

KELLY VALVE

BACKGROUND AND SUMMARY

This invention is related to U.S. Pat. No. 3,915,220; and U.S. Pat. No. 4,050,512, which are for tools connected to drill pipe and lowered down an oil well to test the formation reservoir; whereas the present invention is arranged for installation at an end of a drill kelly, and is summarized in the following objects:

First, to provide a kelly valve structure, which, with a minimum change in parts, may be installed at the lower end of a drill kelly to prevent spillage of mud from the kelly onto the derrick floor when the drill string is being disconnected; or, may be installed at the upper end of the drill kelly to close automatically and stop reverse flow from the drill string, thereby serving as a blow out preventor.

Second, to provide a kelly valve structure, which, when installed at the lower end of the drill kelly and subjected to low pressure existing during connection of the drill string to the kelly or disconnection therefrom, automatically opens in response to the increased drilling fluid pressure established upon resumption of drilling, and thus functions as an anti-spillage valve.

Third, to provide a kelly valve structure which, when installed at the upper end of the drill kelly and subjected to excessive pressure in the drill string is caused to shut off completely and serve to prevent blow outs, and thus serve as a safety valve.

Fourth, to provide a kelly valve structure, including a novelly arranged ball valve, which not only is rotatable between an open and a closed position, but also is axially movable in response to line pressure, when in its closed position, to bypass well fluid to equalize or reduce pressure differential across the valve.

DETAILED DESCRIPTION

Figures 1, 2, 3:
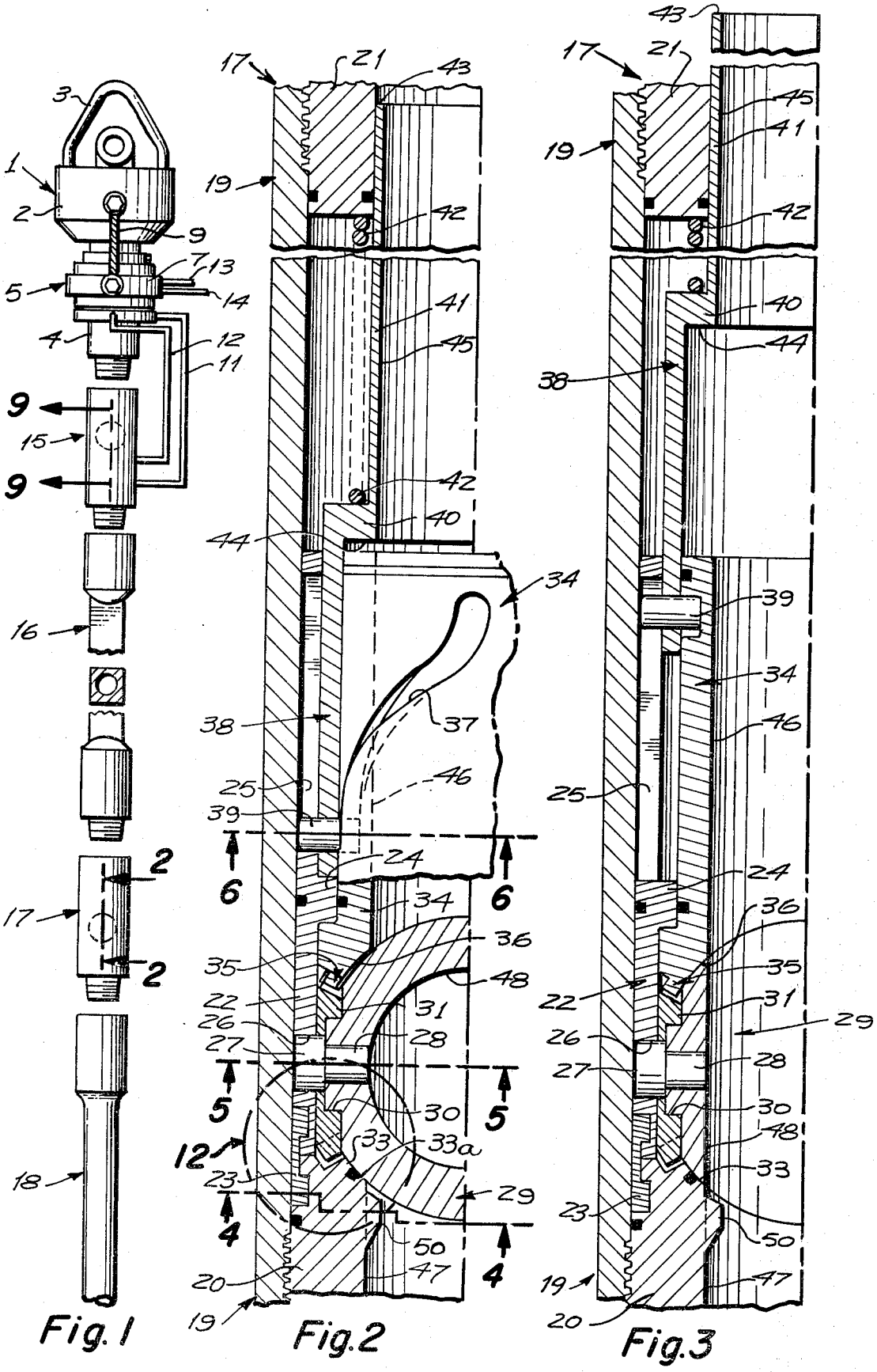
FIG. 1 is an exploded view showing a supporting swivel, a drilling kelly and drill pipe with a safety valve, an anti-spillage valve, disposed respectively at the upper and lower ends of the drill kelly.
FIG. 2 is a fragmentary longitudinal quarter sectional view taken essentially through 2—2 of FIG. 1, showing the anti-spillage valve used at the lower end of the kelly, the valve being shown in its closed position.
FIG. 3 is a longitudinal fragmentary quarter sectional view corresponding to FIG. 2, showing the valve in its open position.
Figure 11:
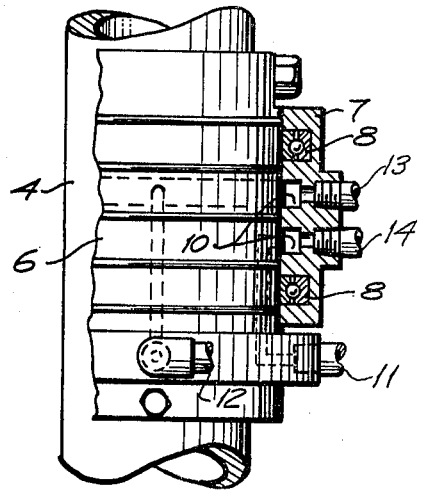
FIG. 11 is a fragmentary elevational view of the rotatable drilling fluid swivel stem, showing partly in section and partly in elevation a control fluid transfer assembly.

Referring to FIG. 1, the kelly valves are suspended from a conventional drilling fluid swivel 1 supported within a drilling derrick, not shown. The swivel 1 includes a housing 2 and supporting bail 3. Extending downwardly from the housing 2 is a rotatable stem 4 on which is mounted a control fluid transfer assembly 5 shown in FIG. 11.

The assembly 5 includes an inner sleeve 6 and an outer sleeve 7 journalled by bearings 8 which enable the inner sleeve 6 to rotate with the stem 4 and the outer sleeve 7 to be fixed against rotation by a tie cable or chain 9. Between the bearings 8 is a pair of sealed annular chambers 10 communicating with control lines 11, 12, 13 and 14.

Secured to the stem 4, by conventional fittings, is a safety valve 15 which is connected by conventional fittings to the upper end of the drill kelly 16. The lower end of the drill kelly 16 is joined to an anti-spillage valve 17 which in turn is secured to a drill string 18. The safety valve 15 and the anti-spillage valve 17 are two embodiments of the present invention.

Referring to FIGS. 2, 3, 4, 5 and 6, these views show the kelly valve employed as an anti-spillage valve 17.

The valve includes a cylindrical housing 19 joined by lower and upper joint couplings to the drill string 18 and to the drill kelly 16 by means of internal end fittings 20 and 21. Extending upwardly from the end fitting 20 is a valve journal sleeve 22 in contact with the cylindrical housing 19 and in longitudinal relation therewith by means of a split retaining ring 23 joining the journal sleeve 22 to the end fitting 21. The sleeve 22 is provided with an internal rib 24, intermediate to its ends, and above the rib is provided with diametrically disposed axially extending slots 25.

Adjacent to the retaining ring 23, the journal sleeve 22 is provided with a pair of diametrically disposed perforations 26 which receive journal pins 27 having radially inwardly extending shanks 28 of reduced diameter. The shanks 28 form journals for the ball valve 29. The ball valve is provided with a shallow polygonal boss 30 surrounding one of the shanks 28. The boss serves to secure a pinion gear 31 to the valve 29. The sleeve 22 is provided with slots 32 which clear the pinion gear 31 and expose the periphery thereof for engagement. The internal end fitting 21 is provided with a spherical zone which forms a bearing and seal area 33 engaged by the ball valve 29. The seal area 33 contains an O-ring seal **33*a*. Disposed at the upper side of the ball valve, as viewed in FIGS. 2 and 3, there is provided a gear sleeve 34, having at its lower end a drive gear 35, engaging the pinion gear 31. Adjacent the drive gear 35, the gear sleeve 34 includes a spherical zone 36, which clears the ball valve 29**.

The gear sleeve 34 extends axially upward from the ball valve 29, is retained by the internal rib 24 and is provided with a pair of diametrically disposed helical drive slots 37. Located between the outer sleeve 22 and the gear sleeve 34 is an intermediate or drive sleeve 38, having a pair of diametrically disposed drive pins 39. The radially outer ends of the drive pins 39 are recieved in the axially extending slots 25 whereas the radially inner ends of the drive pins 39 are received in the helical drive slots 37.

Above the gear sleeve 34 the drive sleeve 38 is provided with an internal flange 40 confronting the upper extremity of the gear sleeve 34. The radially inner extremity of the flange 40 is provided with an axial or upward extension sleeve 41 which forms a sliding fit with the radially inner surface of the upper internal end fitting 21. A spring 42 is interposed between the upper end fitting 21 and the internal flange 40. The extension sleeve 41 is relatively thin and its upper end provides a pressure surface 43 of small area which is opposed by the substantially greater pressure surface 44 of the internal flange 40 so that fluid pressure within the sleeve 38 exerts a net upward force on the sleeve 38 opposing the spring 42.

The radially inner surface 45 of the extension 41, the radially inner surface 46 of the gear sleeve 34 and the radially inner surface 47 of the end fitting 20 are of equal diameter and the ball valve 29 is provided with a transverse bore 48 of equal diameter.

When the kelly valve is utilized as an anti-spillage valve 17, operation is as follows:

The drive kelly 16 and drill string 18 are disposed at opposite ends of the anti-spillage valve 17. When drilling fluid is supplied under pressure through the swivel, the kelly, and the valve to the drill string, the internal pressure exerts a force on the piston or pressure face 44 less 43, as shown in FIG. 3, whereby the ball valve is moved to and held in its open position. When the pressure of the drilling fluid is reduced for the purpose of adding a section of pipe to the drill string 18, the spring 42 urges the intermediate sleeve 38 downward from the position shown in FIG. 2, causing the ball valve 29 to be turned to its closed position shown in FIG. 2. Because the drilling fluid is shut off prior to disconnecting the drill string 18 and the drilling fluid pump is again activated after the new section of pipe is added to the drill string the anti-spillage valve opens and closes automatically.

Figure 12:
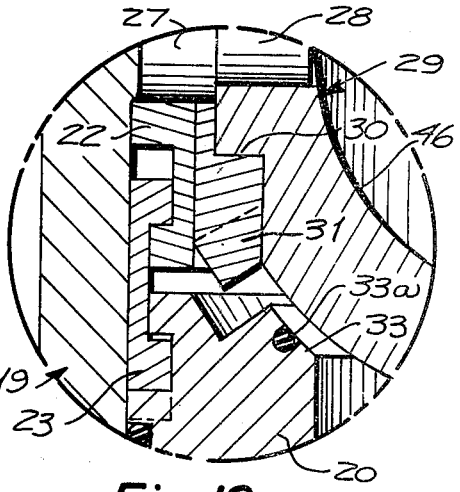
FIG. 12 is an enlarged fragmentary sectional view taken within circle 12 of FIG. 2 showing the ball valve displaced with respect to its valve seat to permit limited bypass of drilling fluid so as to effect equalization of pressure.
Figure 13:
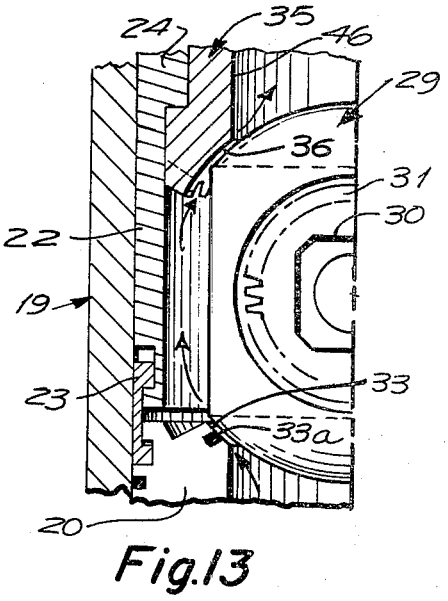
FIG. 13 is a fragmentary sectional view of the ball valve housing taken through 13—13 of FIG. 5, with the ball valve in elevation, showing the drilling fluid bypass.

Referring to FIGS. 12 and 13, operating conditions occur in which it is desired to provide a bypass around the ball valve although the valve is in its closed position. This is accomplished by providing a limited amount of relative longitudinal travel between the internal end fitting 20 and the ball valve 29 as shown in FIGS. 12 and 13.

Figure 7:
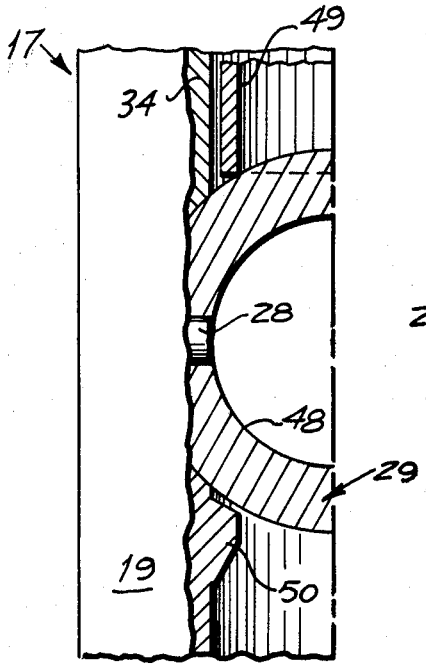
FIG. 7 is a fragmentary quarter sectional view corresponding to the lower portion of FIG. 2, the ball valve being shown in a closed position and showing the lock-open safety tube engaging the valve.
Figure 6:
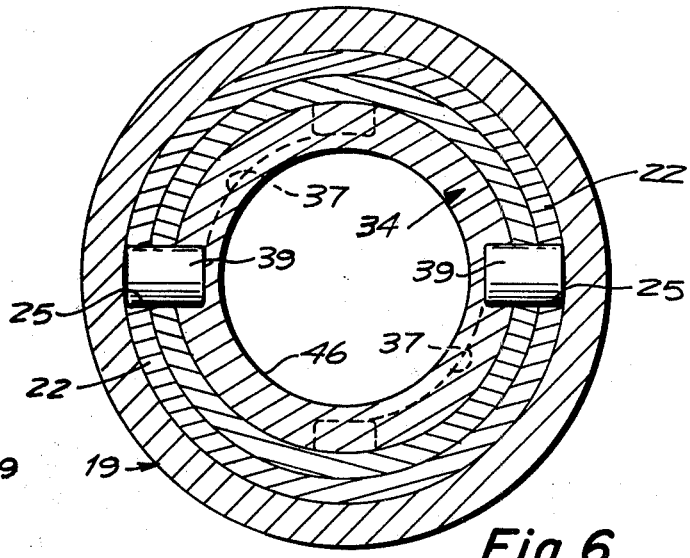
FIGS. 4, 5 and 6 are transverse sectional views taken respectively through 4—4, 5—5 and 6—6 of FIG. 2.
Figure 5:
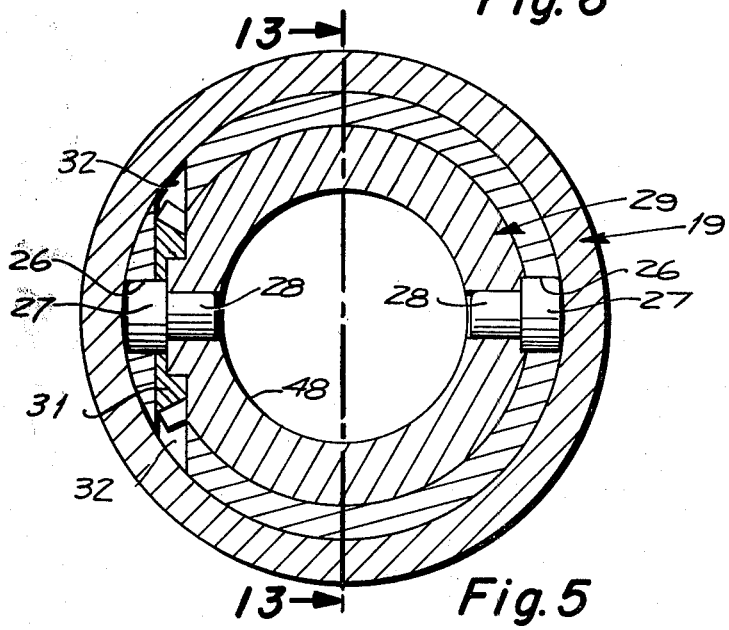
Figure 8:
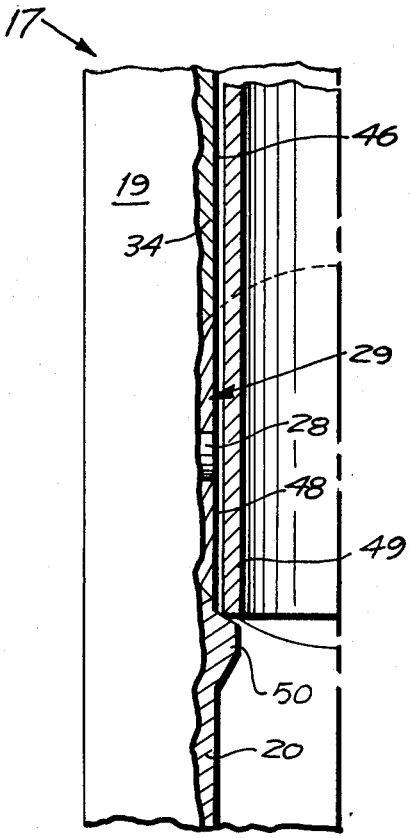
FIG. 8 is a fragmentary sectional view corresponding to FIG. 7, showing the ball valve in its open position and with the safety tube received in the valve and maintaining the valve in its open position.
Figure 4:
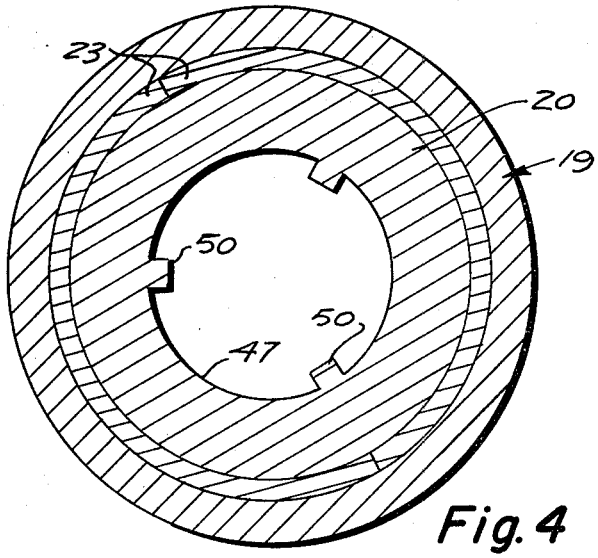

Referring to FIGS. 7 and 8, it sometimes occurs that the drill stem becomes stuck while drilling a well with the lower end of the drill kelly inaccessible because it is below the rotary table. Under such conditions it is desirable to lock the anti-spillage valve in its open position. When such conditions occur the kelly is disconnected at its upper end and a lock-open safety tube 49, dimensioned to fit freely within the kelly, is dropped through the kelly and comes to rest on the closed valve, as shown in FIG. 7. In order to utilize the tube 49, the end fitting 20 is provided below the ball valve 29 with a set of internal stop lugs 50. Whereupon drilling fluid pressure is reestablished momentarily permitting the tube 49 to enter the open ball valve 29, as shown in FIG. 8, and come to rest on the stop lugs 50. The valve is rendered inoperative and the drilling string may be manipulated to overcome whatever problem has arisen, including the lowering of tools through the safety tube 49.

Figure 9:
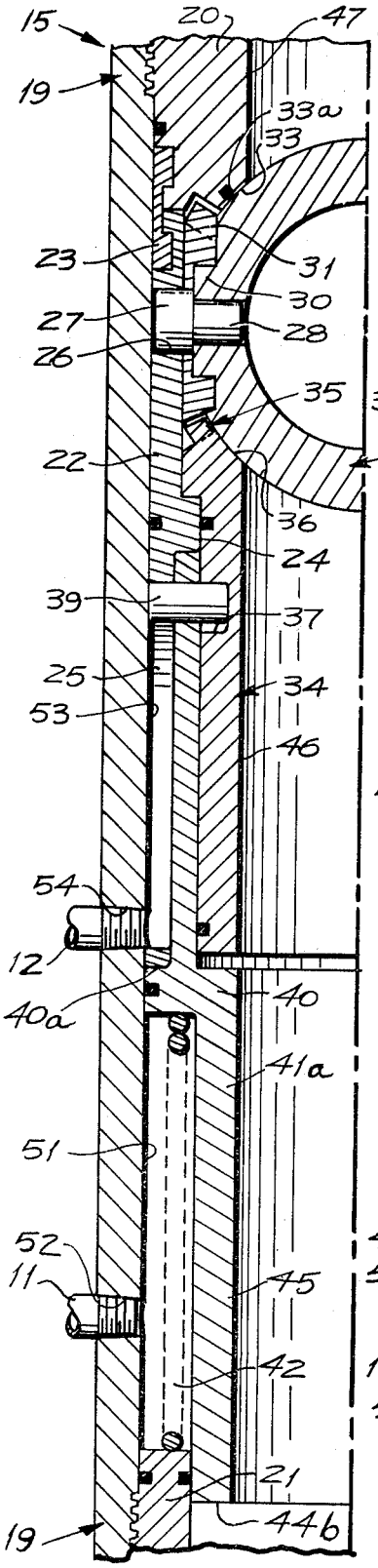
FIG. 9 is a fragmentary longitudinal quarter sectional view showing the valve arranged for use as a safety valve, the section being taken through 9—9 of FIG. 1, the valve being shown in its closed position.
Figure 10:
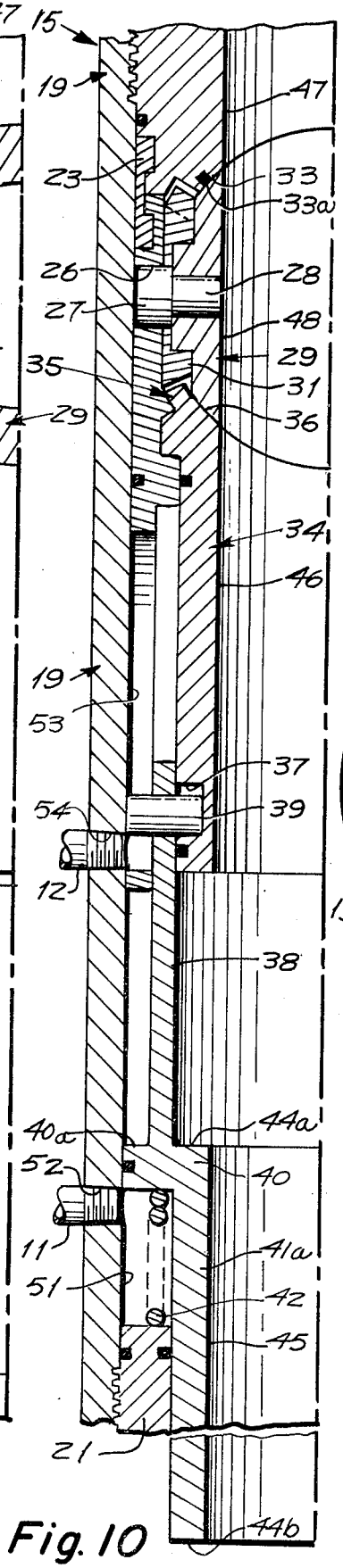
FIG. 10 is a similar fragmentary longitudinal quarter sectional view of the safety valve, the valve being shown in its open position.

Referring to FIGS. 9 and 10, it is useful to provide external control for the kelly valve. This may be accomplished by inverting the valve, as shown in FIGS. 9 and 10 to function as the safety valve 15 and provide for external control rather than internal control. Most of the parts are identical in both the anti-spillage valve 17, and the safety valve 15, and bear the same numerical indicia.

The modifications are as follows:

The extension 41 is increased in wall thickness as indicated by 41*a*, so as to provide a neutralized pressure end surface 44*a*. However, the internal flange 40 is provided with an external flange 40*a* which engages the inner surface of the housing 19 and forms with the internal end fitting 21, the opposite ends of pressure fluid chamber 51 having a pressure fluid port 52 joined to the control line 11. An opposing pressure fluid chamber 53 is formed with sleeve 34, journal sleeve 22, and housing 19 which is provided with a pressure fluid port 54 joined to the control line 12.

Operation of the kelly valve when used as a safety valve 15, is as follows:

Assuming the ball valve 29 is in its closed position, as shown in FIG. 9, the application of pressure control fluid through line 12 to the pressure fluid chamber 53 causes the intermediate sleeve to move from the closed position shown in FIG. 9 to the open position shown in FIG. 10. This movement causes a 90° rotation of the ball valve 29. When the valve is in its open position a supply of pressure fluid through control line 11 into the pressure fluid chamber 51 causes the pressure fluid chamber 51 to extend, reversing the movement of the intermediate sleeve 38 so as to close the ball valve 29.

Except for the force exerted by the spring 42, movement of the valve is dependent entirely upon the control pressure as applied to the chambers 51 or 53, through the control lines 13 or 14. Appropriate control fluid may be remotely controlled from the derrick floor manually or may be controlled automatically. For example, is excess drilling fluid pressure develops in the drill string, this may be sensed in the fluid supply line by automatic means, not shown, to cause a switching of the control fluid resulting in a movement of the valve from its open position to its closed position. In the event that the control lines 11 and 12 or 13 and 14 were severed by cutting or fire, the spring 42 will close the valve automatically, thus providing the safety protection its name implies.

An alternate method of controlling the safety valve, not shown, would be to sense the drilling fluid pressure on a pressure face 44*b* by further modifying 41*a* so that the outer diameter of extension sleeve 41*a* would be larger in area than the opposing area of 44*a*. This "sensed" drilling fluid pressure would be transfered by piston 40*a* to the control fluid in chamber 53 holding the valve open against the force of spring 42. This increase of control pressure in lines 12 and 14 would, by an automatic means at a predetermined pressure, switch the control fluid to cause the valve to close.

It will be noted that appropriate seals, such as O-rings are provided where needed.

Having fully described my invention it is to be noted that I am not to be limited to the details herein set forth, but that my invention is of the full scope of the appended claims.

I claim:

1. A valve structure for installation in a drilling fluid line at an end of a drill kelly to control flow of drill fluid therethrough, comprising:

a. a tubular housing having a fitting at each end for removably installing the housing at either end of the drill kelly;

b. a journal sleeve mounted in the housing and having diametrically disposed journal pins;

c. a ball valve rotatable on the journal pins and having a bore movable between an open position coaxial with the journal sleeve and a transverse closed position;

d. a gear sleeve coaxial with the journal sleeve;

e. a gear drive disposed between the ball valve and gear sleeve;

f. a drive sleeve interposed between the journal sleeve and gear sleeve including radial drive pins protruding radially inwardly and radially outward therefrom;

g. and longitudinal grooves provided in the journal sleeve and gear sleeve, one of the grooves being helical whereby longitudinal movement of the sleeves causes the gear drive to effect rotation of the ball valve between its open and closed positions.

2. A valve structure, as defined in claim 1, which is arranged for installation between the lower end of the drill kelly and the portion of the drilling fluid line receiving drilling fluid therefrom, wherein:

a. the drive sleeve includes a piston element exposed to fluid pressure upstream of the ball valve, exerting a force tending to move the ball valve from its closed to its open position;

b. and a spring operable to move the ball valve from its open to its closed position on termination of fluid pressure to prevent drainage of fluid from the drill kelly upon disconnection of the valve structure from the drilling fluid line.

3. A valve structure, as defined in claim 1, which is arranged for installation between the upper end of the drill kelly and the portion of the drilling fluid line supplying drilling fluid thereto, wherein:

a. the drive sleeve includes piston elements exposed to opposed pressure chambers;

b. and means is provided to supply pressure fluid to the chambers to effect movement of the ball valve between its open and closed positions.

4. A valve structure, as defined in claim 1, wherein:

a. the ball valve is axially engageable with a valve seat;

b. means is provided to permit relative axial movement between the ball valve and valve seat to effect bypass of fluid while the ball valve is otherwise in its closed position.

5. A valve structure, as defined in claim 1, wherein:

a. internal stop lugs are positioned contiguous to the bore of the ball valve;

b. and a tubular safety sleeve dimensioned to pass through the bore of the ball valve and engage the stop lugs to maintain the ball valve in its open position.

6. A valve structure for installation in a drilling fluid line at an end of a drill kelly to control flow of drill fluid therethrough, comprising:

a. a tubular housing having a fitting at each end for removably installing the housing in a drilling fluid line at either end of the drill kelly;

b. an inner sleeve having a bore coaxial with the housing and including an axially directed drive gear;

c. a longitudinally movable means for effecting a predetermined arcuate movement of the inner sleeve and its drive gear;

d. a ball valve having a driven gear engageable by the drive gear, the ball valve having a bore oriented for movement between an open position aligned with the bore of the inner sleeve and a transverse closed position;

e. means for activating the longitudinally movable means to effect movement of the ball valve between its open and its closed position;

f. the valve structure is adapted to be interposed between the lower end of the drill kelly and the drilling fluid line;

g. and the activating means includes a pressure responsive element operable to maintain the ball valve open when the drill kelly is connected to the drilling fluid line and is subjected to a predetermined operating pressure therein, and a spring, operable upon a predetermined reduced pressure to close the ball valve thereby to permit disconnection of the drill kelly from the drilling fluid line.

7. A valve structure for installation in a drilling fluid line at an end of a drill kelly to control flow of drill fluid therethrough, comprising:

a. a tubular housing having a fitting at each end for removably installing the housing in a drilling fluid line at either end of the drill kelly;

b. an inner sleeve having a bore coaxial with the housing and including an axially directed drive gear;

c. a longitudinally movable means for effecting a predetermined arcuate movement of the inner sleeve and its drive gear;

d. a ball valve having a driven gear engageable by the drive gear, the ball valve having a bore oriented for movement between an open position aligned with the bore of the inner sleeve and a transverse closed position;

e. means for activating the longitudinally movable means to effect movement of the ball valve between its open and its closed position;

f. the valve structure is adapted to be interposed between the upper end of the drill kelly and the drilling fluid feed line;

g. and the activating means includes a pair of externally accessible opposed pressure chambers.

8. A valve structure for installation in a drilling fluid line at an end of a drill kelly to control flow of drill fluid therethrough, comprising:

a. a tubular housing having a fitting at each end for removably installing the housing in a drilling fluid line at either end of the drill kelly;

b. an inner sleeve having a bore coaxial with the housing and including an axially directed drive gear;

c. a longitudinally movable means for effecting a predetermined arcuate movement of the inner sleeve and its drive gear;

d. a ball valve having a driven gear engageable by the drive gear, the ball valve having a bore oriented for movement between an open position aligned with the bore of the inner sleeve and a transverse closed position;

e. means for activating the longitudinally movable means to effect movement of the ball valve between its open and its closed position;

f. a tube is insertable through the inner sleeve for engagement with the ball valve when in its closed position, the tube being further slidable through the ball valve upon movement of the ball valve to its open position;

g. and an internal projection is disposed beyond the ball valve to maintain the tube in a position wherein the ball valve is maintained open.

9. A valve structure, comprising:

a. a tubular housing;

b. tool joint couplings disposed at opposite ends of the housing for interposing the tubular housing between a drill kelly and a drilling fluid line;

c. a journal sleeve fixed within the housing near one end thereof;

d. a pair of diametrically disposed journal pins carried by the journal sleeve;

e. a spherical valve carried by the journal pins having a bore rotatable between a closed and an open position with respect to the journal sleeve;

f. a gear sleeve within the journal sleeve and confronting the spherical valve;

g. the gear sleeve and spherical valve having mating driving and driven gears operable, upon partial rotation of the gear sleeve, to turn the spherical valve between a closed position and an open position;

h. drive pins carried by the drive sleeve, and grooves, including axial grooves and helical grooves carried by the journal sleeve and gear sleeve operable upon axial movement of the drive sleeve to effect corresponding opening and closing of the spherical valve;

i. and means for effecting axial movement of the drive sleeve.

10. A valve structure, as defined in claim 9, wherein said means for effecting axial movement of the drive sleeve comprises:

a. confronting an axially directed surface of the drive sleeve exposed to pressure from within the housing to effect axial movement of the drive sleeve in one direction;

b. and a spring to effect axial movement of the drive sleeve in the opposite direction.

11. A valve structure, as defined in claim 9, wherein said means for effecting axial movement of the drive sleeve comprises:

a. an opposed pair of axially expansible and contractable pressure chambers;

b. and an external source of pressure fluid for said chambers.

12. A valve structure, as defined in claim 9, wherein:

a. a safety tube is insertable through the gear sleeve for engagement with the spherical valve shen in its closed position, the tube being further slidable through the spherical valve upon movement of the spherical valve to its open position;

b. and means is provided to retain the tube within the spherical valve, thereby to maintain the spherical valve in its open position.

* * * * *

UNITED STATES PATENT AND TRADEMARK OFFICE

CERTIFICATE OF CORRECTION

PATENT NO. : 4,262,693

DATED : April 21, 1981

INVENTOR(S) : Bernhardt F. Giebeler

It is certified that error appears in the above—identified patent and that said Letters Patent is hereby corrected as shown below:

Abstract, line 2, before "kelly" delete "drilling".

Column 1, line 5, change "3,915,220" to read --3,915,228--.

Column 1, line 40, before "kelly" change "drilling" to read --drill--.

Column 3, line 32, before "kelly" delete "drive".

Column 4, line 45, change "is" at beginning of line to read --if--.

Column 4, line 59, correct spelling of "transferred".

Column 6, line 52, delete "feed".

Column 8, line 27, after "valve" correct spelling of "when".

Signed and Sealed this

*Fourteenth* Day of *July 1981*

[SEAL]

*Attest:*

GERALD J. MOSSINGHOFF

*Attesting Officer*

*Commissioner of Patents and Trademarks*